US005970844A

United States Patent [19]

Lynn et al.

[11] Patent Number: 5,970,844

[45] Date of Patent: Oct. 26, 1999

[54] CYLINDER SLEEVE ASSEMBLY

[75] Inventors: William H. Lynn, Kohler; Paul J. Thomas, Sheboygan Falls; Gerald A. Armfield, Fond du Lac, all of Wis.

[73] Assignee: Thomas Industries, Inc., Sheboygan, Wis.

[21] Appl. No.: 09/028,076

[22] Filed: Feb. 23, 1998

Related U.S. Application Data

[60] Provisional application No. 60/033,813, Mar. 7, 1997.

[51] Int. Cl.[6] ..... F01B 13/04

[52] U.S. Cl. ..... 92/12.2; 92/57; 92/71; 92/128; 417/269

[58] Field of Search ..... 92/12.2, 57, 71, 92/128; 417/269; 74/60

[56] References Cited

U.S. PATENT DOCUMENTS

| | | | |
|---|---|---|---|
| 3,712,759 | 1/1973 | Olson, Jr. | 417/269 |
| 5,046,403 | 9/1991 | Riedhammer | 92/71 X |
| 5,381,724 | 1/1995 | Kawahara et al. | 92/12.2 |
| 5,584,675 | 12/1996 | Steurer et al. | 417/372 |
| 5,730,042 | 3/1998 | Engel | 92/12.2 |

FOREIGN PATENT DOCUMENTS

| | | |
|---|---|---|
| 0 446 006 | 9/1991 | European Pat. Off. . |
| 0 744 541 | 11/1996 | European Pat. Off. . |
| WO 97/05382 | 2/1997 | WIPO . |

*Primary Examiner*—Hoang Nguyen
*Attorney, Agent, or Firm*—Quarles & Brady LLP

[57] ABSTRACT

A cylinder sleeve is composed of multiple identical interlocking sleeve elements. Each sleeve element has a circular cylindrical portion and an integral circular arc portion tangent to the cylindrical portion. The circular arc portion has a boss on one end and an offset finger on the other which mates with the boss of an adjacent sleeve element to fix the adjacent sleeve elements together radially.

9 Claims, 1 Drawing Sheet

CYLINDER SLEEVE ASSEMBLY

CROSS REFERENCES TO RELATED APPLICATIONS

This application claims the benefit of U.S. Provisional Application No. 60/033,813, filed on Mar. 7, 1997.

STATEMENT REGARDING FEDERALLY SPONSORED RESEARCH

Not Applicable

BACKGROUND OF THE INVENTION

This invention relates to axial piston fluid pumping apparatus, and more particularly to an assembly of parallel cylinder sleeves for the axial pistons.

International Patent Application No. PCT/US96/12362 filed Jul. 24, 1996, for "Fluid Pumping Apparatus" and published as International Publication No. WO97/05382, discloses a compact axial piston pumping apparatus assembled from stacked components. The disclosure of the international application is hereby incorporated by reference as though fully set forth herein. One of the stacked components of the axial piston pumping apparatus is a cylinder sleeve member formed as a single extruded aluminum element. The cylinder sleeve member includes a large central opening and three cylinder bores symmetrically disposed about the central opening and parallel with each other. The central opening receives the shaft of a drive motor which mounts the pistons that operate in the cylinder bores.

The present invention is directed to an alternative construction for such a cylinder sleeve.

SUMMARY OF THE INVENTION

In accordance with the invention, a plurality of identical cylinder sleeve elements interlock with each other to form a large central opening and symmetrically spaced cylinder bores. The cylinder sleeve elements may include other integral features such as bolt receptors to receive through bolts which connect the cylinder sleeve assembly with other of the stacked components that make up the axial piston fluid apparatus. The identical cylinder sleeve elements may be formed of extruded aluminum.

It is a principal object of the invention to provide an assembly of parallel cylinder sleeves formed of identical interlocking elements.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
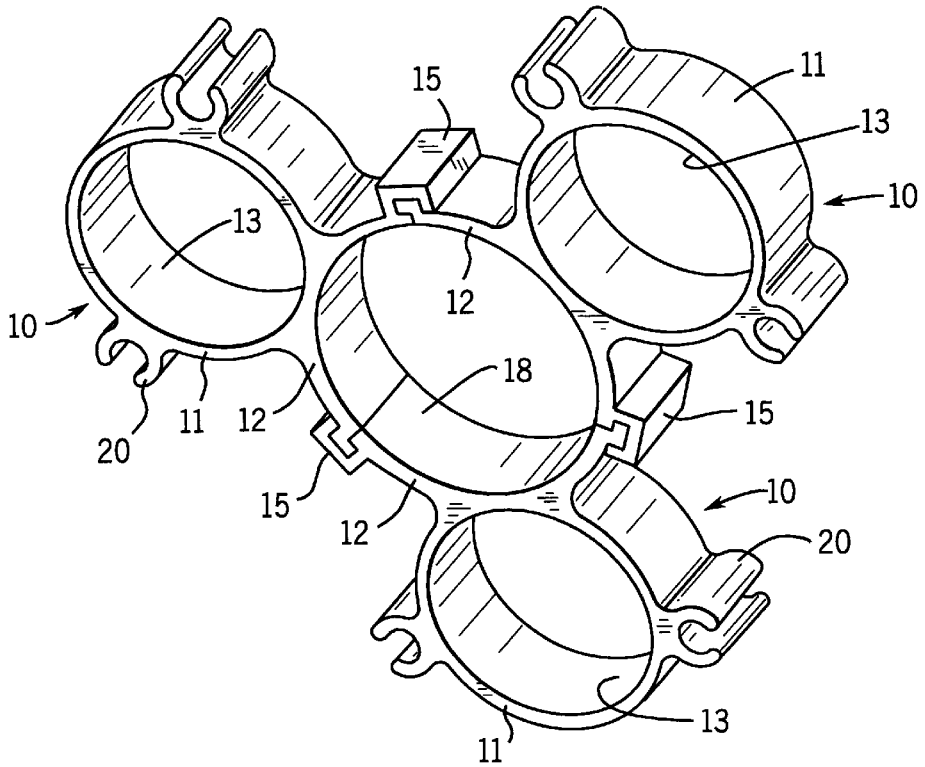
FIG. 1 is a view in perspective of a cylinder sleeve assembly in accordance with the invention.
Figure 2:
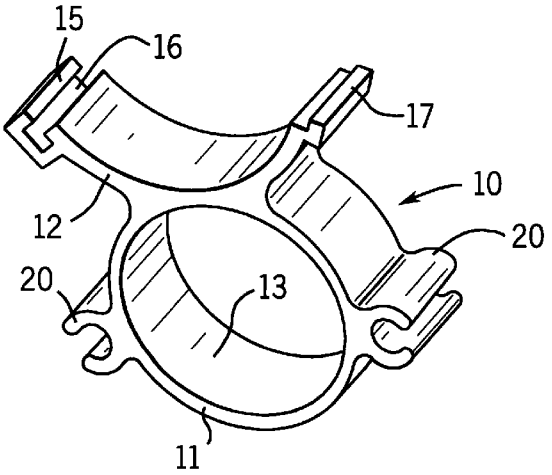
FIG. 2 is a view in perspective of an individual cylinder sleeve element which forms the assembly of FIG. 1.
Figure 3:
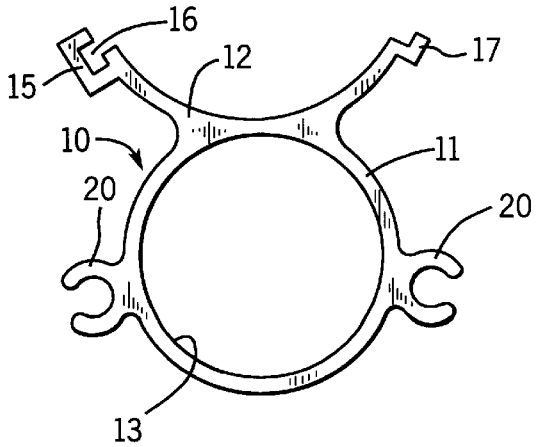
FIG. 3 is an end view of the cylinder sleeve element.

The cylinder sleeve assembly is formed of three identical cylinder sleeve elements 10. Each of the elements 10 includes a circular cylindrical portion 11 and an integral circular arc portion 12. The arc portion 12 is tangent to the cylindrical portion 11. The cylindrical portion 11 defines a cylindrical bore 13 in which a piston will operate. One end of each arc portion 12 is formed with a boss 15 having an opening 16. The other end of each arc portion 12 is formed with an offset finger 17 which mates with the opening 16 in the boss 15 of an adjacent element 10. As shown in the drawing, three elements 10, when joined together, interlock to form an assembly which includes a large central opening 18 defined by the arc portions 12 of the elements 10.

The elements 10 may also include integral bolt receptors 20 extending from opposite sides of the cylindrical portion 11 to receive through bolts for connection of the cylinder sleeve assembly with other components of an axial piston device.

Each element 10 can be formed as an aluminum extrusion. Extruding the separate elements 10 allows greater accuracy in holding the tolerances for the cylindrical bores 13 of the sleeves and for the symmetrical spacing of the sleeves relative to each other.

Although the preferred assembly includes three cylinder sleeve elements, any multiple of such elements could be employed. The assembly could be formed of two or more individual cylinder sleeve elements by adjusting the sweep of each arc portion.

We claim:

1. A cylinder sleeve member for an axial piston pumping apparatus, said member defining a central opening and a number of cylinders radially equi-angularly spaced around said opening, said member comprising the same number of cylinder sleeve elements, each said element having a circular cylindrical portion which defines one of said cylinders and a connecting portion integrally formed with said circular cylindrical portion, said connecting portion defining a portion of said central opening, and means at opposite ends of each said connecting portion for connecting the connecting portions of adjacent sleeve elements.

2. A cylinder sleeve member as claimed in claim 1, wherein the sleeve elements are identical to one another.

3. A cylinder sleeve member as claimed in claim 1, wherein said connecting portion of each said sleeve element is in the form of a circular arc, and is oriented at a tangent to the circular cylindrical portion of said sleeve element, so that said central opening is circular.

4. A cylinder sleeve member as claimed in claim 1, wherein said means at opposite ends of each said connecting portion comprises a boss at one end which defines an opening that extends in a direction parallel to the axial direction, and a finger at the opposite end of said connecting portion of a shape that mates with the boss of an adjacent connecting portion so as to fix the adjacent sleeve elements together radially.

5. A cylinder sleeve member as claimed in claim 4, wherein said opening and finger are L-shaped in radial cross-section.

6. A cylinder sleeve member as claimed in claim 1, wherein at least one bolt receptor is formed integrally with each said cylinder sleeve element.

7. A cylinder sleeve member as claimed in claim 6, wherein each said bolt receptor is formed integrally with said circular cylindrical portion.

8. A cylinder sleeve member as claimed in claim 1, wherein each said sleeve element is an extrusion.

9. A cylinder sleeve member as claimed in claim 8, wherein each said sleeve element is aluminum.

* * * * *